US011209204B2

(12) United States Patent
Gopalnarayanan

(10) Patent No.: US 11,209,204 B2
(45) Date of Patent: Dec. 28, 2021

(54) HEAT PUMP SYSTEM DEFROSTING OPERATIONS

(71) Applicant: Rheem Manufacturing Company, Atlanta, GA (US)

(72) Inventor: Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 221 days.

(21) Appl. No.: 16/428,453

(22) Filed: May 31, 2019

(65) Prior Publication Data

US 2020/0378677 A1 Dec. 3, 2020

(51) Int. Cl.

| | |
|---|---|
| ***F25D 21/00*** | (2006.01) |
| ***F25B 13/00*** | (2006.01) |
| ***F25B 41/20*** | (2021.01) |
| ***F25B 41/30*** | (2021.01) |

(52) U.S. Cl.

CPC ..... *F25D 21/002* (2013.01); *F25B 13/00* (2013.01); *F25B 41/20* (2021.01); *F25B 41/30* (2021.01); *F25B 2400/13* (2013.01)

(58) Field of Classification Search

CPC ..... F25D 21/002; F25B 41/20; F25B 41/30; F25B 13/00; F25B 2400/13; F25B 49/02; F25B 2313/0315; F25B 2313/0314; F25B 2400/0409; F25B 47/025; F25B 2600/2501; F25B 2400/0411; F25B 2313/02741; F25B 41/39

See application file for complete search history.

(56) References Cited

U.S. PATENT DOCUMENTS

| | | | | |
|---|---|---|---|---|
| 6,379,122 | B1 * | 4/2002 | Little | F04B 49/08 417/292 |
| 9,976,785 | B2 * | 5/2018 | Goel | F25B 45/00 |
| 2008/0127667 | A1 | 6/2008 | Buckley et al. | |
| 2015/0330684 | A1 | 11/2015 | Goel et al. | |
| 2019/0351739 | A1 * | 11/2019 | Kim | B60H 1/32281 |

FOREIGN PATENT DOCUMENTS

KR 20120047677 A * 5/2012

* cited by examiner

*Primary Examiner* — Ana M Vazquez
(74) *Attorney, Agent, or Firm* — Troutman Pepper Hamilton Sanders LLP

(57) ABSTRACT

A heat pump system including a charge compensator having a liquid line port for an inflow of a refrigerant into the charge compensator and for an outflow of the refrigerant from the charge compensator. The heat pump system further includes an isolation valve configured to control flows of the refrigerant to and from the charge compensator through a liquid line piping of the heat pump system based on whether the heat pump system is operating in a cooling mode, a defrost mode, or a heating mode, where the liquid line port is fluidly coupled to the liquid line piping of the heat pump system.

18 Claims, 12 Drawing Sheets

HEAT PUMP SYSTEM DEFROSTING OPERATIONS

TECHNICAL FIELD

The present disclosure relates generally to heat pump systems, and more particularly to improved defrosting operations of heat pump systems.

BACKGROUND

Heat pump systems typically operate in a heating mode and a cooling mode. When operating in a cooling mode to cool a particular space, the outdoor coil of a heat pump system operates as a condenser that dissipates heat outdoors. When the operating in a heating mode to heat a particular space, the outdoor coil of a heat pump system operates as an evaporator. In some cases, frost may form on the outdoor coil during heating mode operations, which may result in inefficient operations of the heat pump system. To remove the frost from the outdoor coil, the heat pump system typically interrupts a heating mode operation and temporarily operates in a cooling mode that is generally referred to as a defrost mode to distinguish it from typical cooling mode operations performed for the purpose of cooling a particular space.

During typical cooling mode operations, refrigerant that is removed from circulation and stored in a charge compensator during the heating mode operation is returned back to circulation. As in typical cooling operations, during defrost mode operations, refrigerant that is removed from circulation and stored in the charge compensator during the heating mode operation is also returned back to circulation. The refrigerant that is returned to circulation from the charge compensator during a defrost operation may result in the defrost mode operation lasting longer than desired. For example, a longer defrost operation may be undesirable because of the longer interruption of a heating mode operation, which is a normal mode of operation of the heat pump system but for the need to defrost the outdoor coil. Thus a solution that results in shorter defrost operations of heat pump systems may be desirable.

SUMMARY

The present disclosure relates generally to heat pump systems, and more particularly to improved defrosting operations of heat pump systems. In some example embodiments, a heat pump system including a charge compensator having a liquid line port for an inflow of a refrigerant into the charge compensator and for an outflow of the refrigerant from the charge compensator. The heat pump system further includes an isolation valve configured to control flows of the refrigerant to and from the charge compensator through a liquid line piping of the heat pump system based on whether the heat pump system is operating in a cooling mode, a defrost mode, or a heating mode, where the liquid line port is fluidly coupled to the liquid line piping of the heat pump system.

In another example embodiment, a method of operating a heat pump system that includes an isolation valve includes controlling, by a control unit, the isolation valve to provide an inflow path for a refrigerant to flow to a charge compensator during a heating mode operation of the heat pump system. The charge compensator includes a liquid line port for an inflow of the refrigerant into the charge compensator and for an outflow of the refrigerant from the charge compensator. The method further includes controlling, by the control unit, the isolation valve to prevent the refrigerant from flowing from the charge compensator to a system refrigerant circulation piping of the heat pump system through a liquid line piping of the heat pump system during a defrost mode operation of the heat pump system.

In another example embodiment, a method of operating a heat pump system that includes an isolation valve includes opening, by the isolation valve, a flow path for a refrigerant to flow, during a heating mode operation of the heat pump system, from a system refrigerant circulation piping to a charge compensator through a liquid line piping. The charge compensator includes a liquid line port that is coupled to the liquid line piping. The method further includes storing, by the charge compensator, the refrigerant and closing, by the isolation valve, the flow path to prevent the refrigerant stored in the charge compensator from flowing, during a defrost mode operation of the heat pump system, from the charge compensator to the system refrigerant circulation piping through the liquid line piping.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
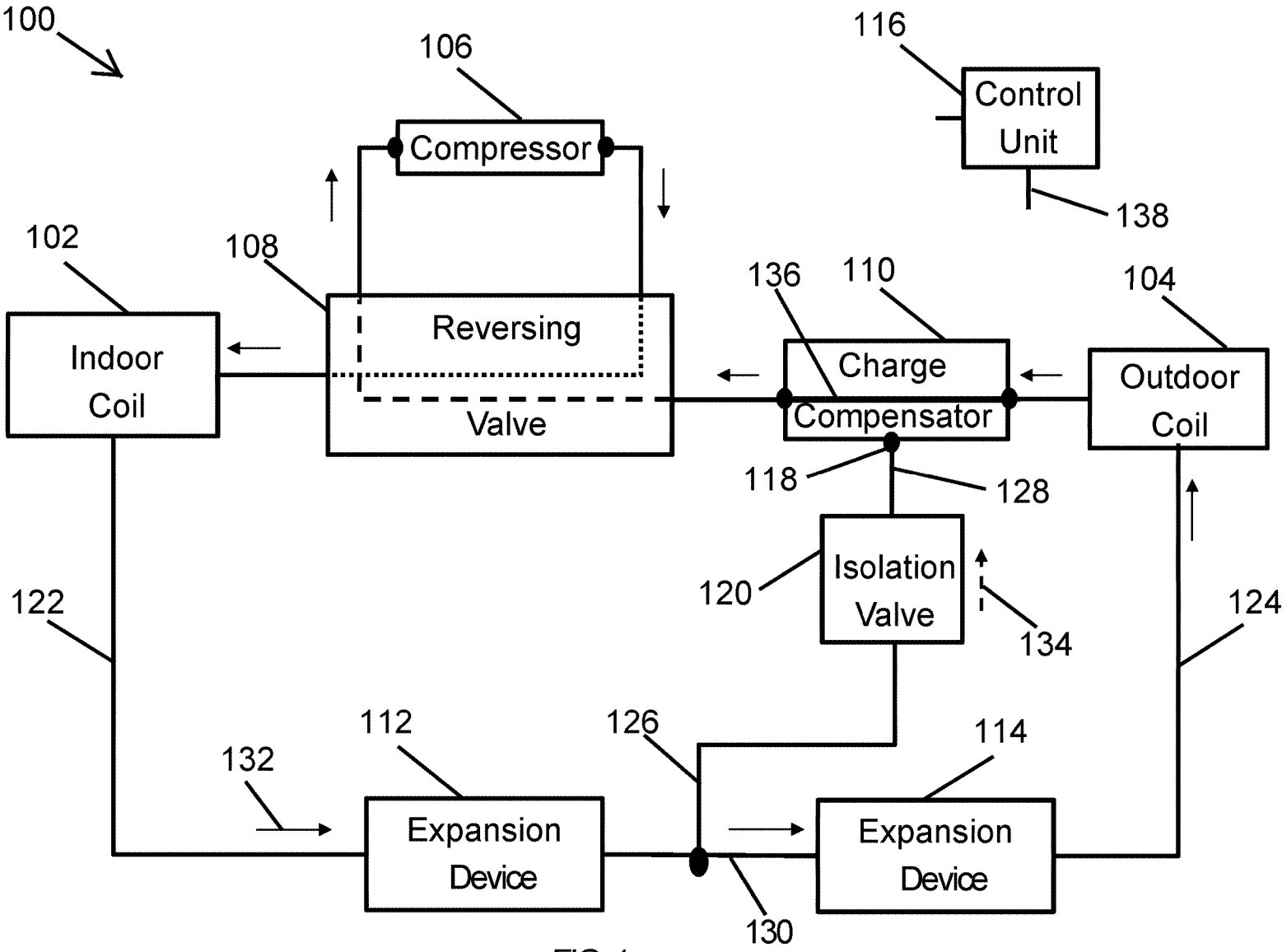
FIG. 1 illustrates a heat pump system including an isolation valve according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings may designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

In some example embodiments, an isolation valve is located along a refrigerant line connecting the charge compensator to the liquid line of a heat pump system to control the flow of refrigerant into and out of the charge compensator of the heat pump system based on the mode of operation of the heat pump system. The charge compensator typically stores extra refrigerant in during heating mode operations and returns the stored refrigerant back into circulation for the cooling mode operations as readily understood by those of ordinary skill in the art with the benefit of this disclosure. During cooling mode operations, the isolation valve is open, allowing refrigerant to flow out of the charge compensator into circulation. During defrost mode operations that interrupt heat mode operations, the isolation valve is closed, thereby isolating the refrigerant in the charge compensator from combining with the refrigerant in circulation in the rest of the system. Isolating the charge compensator during defrost mode operations prevents the refrigerant in the charge compensator entering circulation through the heat pump system, which allows for higher discharge temperature of gas refrigerant leaving the compressor of the heat pump system resulting in faster defrosting of the outdoor coil.

In some example embodiments, a relief valve (e.g., an in-line relief valve) may be placed in parallel with the isolation valve to prevent excessive pressure from building in the charge compensator when the isolation valve is preventing refrigerant flow from the charge compensator into system circulation. The relief valve may be a spring loaded spring valve or another pressure-actuated valve that opens to relieve pressure when the pressure in the charge compensator reaches or exceeds a safety threshold and stays closed prior to the pressure reaching or exceeding the safety threshold. In some example embodiments, the isolation valve may be controlled to release some of the refrigerant stored in the charge compensator into the system circulation during defrost mode operations instead of fully isolating the charge compensator during entire defrost mode operations.

Turning now to the figures, particular example embodiments are described. FIG. 1 illustrates a heat pump system 100 including an isolation valve 120 according to an example embodiment. In some example embodiments, the heat pump system 100 includes an indoor coil 102, an outdoor coil 104, and the isolation valve 120. The heat pump system 100 may include a compressor 106, a reversing valve 108, and a charge compensator 110. The heat pump system 100 may also include expansion devices 112, 114, which could be thermal expansion devices or other types of expansion devices. For example, the expansion devices 112, 114 may be electronically or thermally activated.

In some example embodiments, a control unit 116 may control the operation modes of the heat pump system 100. To illustrate, the control unit 116 may control the reversing valve 108 to control the operation modes of the heat pump system 100 by controlling the direction of system refrigerant flow through the system refrigerant circulation piping of the heat pump system 100. To illustrate, to operate in a heating mode, the control unit 116 may control the reversing valve 108 such that the system refrigerant circulates through the system refrigerant circulation piping in the directions shown by the solid arrows, such as the arrow 132. For example, the system refrigerant circulation piping may include refrigerant pipes 122, 124, 130 and other pipes and connections between the reversing valve 108 and the indoor coil 102, the compressor 106, and the charge compensator 110 as well as between the outdoor coil 104 and the charge compensator 110.

When configured to operate in a heating mode as shown in FIG. 1, the control unit 116 may configure the reversing valve 108 such that system (i.e., circulating) refrigerant flows from the outdoor coil 104 to the suction port of the compressor 106 through the reversing valve 108 and through the charge compensator 110 (i.e., through the flow path 136) and such that the system/circulating refrigerant flows from the discharge port of the compressor 106 to the indoor coil 102 through the reversing valve 108. The circulation of the system refrigerant through the system refrigerant circulation piping is completed by the flow of the system refrigerant from the indoor coil 102 to the outdoor coil 104 through the expansion devices 112, 114. When the heat pump system 100 is configured to operate in a heating mode as shown in FIG. 1, the outdoor coil 104 operates as an evaporator, and the indoor coil 102 operates as a condenser. During heat mode operations, the expansion device 112 throttles the refrigerant flow on the lower pressure side from a higher pressure to a lower pressure while the expansion device 114 acts as a flow passage. During cooling mode operations, the expansion device 114 throttles the refrigerant flow while the expansion device 112 acts as a flow passage.

In some example embodiments, the isolation valve 120 is located to control flows of refrigerant through a liquid line piping of the heat pump system 100. For example, the isolation valve 120 may be a solenoid valve or another type of valve as can be readily understood by those of ordinary skill in the art with the benefit of this disclosure. The isolation valve 120 may provide a single flow path that, when open, allows the flow of refrigerant in both directions depending on the mode of operation of the heat pump system 100. Alternatively, the isolation valve 120 may provide two single direction flow paths or bidirectional that are open or closed under the control of the control unit 116.

In some example embodiments, the liquid line piping may include pipe sections 126, 128 and is coupled to and between the charge compensator 110 and the refrigerant pipe 130. The isolation valve 120 may be in-line with or otherwise coupled to the liquid line piping to control refrigerant flows through the liquid line piping from and to the charge compensator 110 and the refrigerant pipe 130. For example, the pipe section 128 of the liquid line piping may be fluidly coupled to a liquid line port 118 of the charge compensator 110, and the pipe section 126 of the liquid line piping may be fluidly coupled to the refrigerant pipe 130 of the system refrigerant circulation piping.

In some example embodiments, the control unit 116 may control the isolation valve 120 to control flows of refrigerant from and to the charge compensator 110 and the refrigerant pipe 130 through the liquid line piping including pipe sections 126, 128. For example, the control unit 116 may send a control signal via an electrical connection 138 to the isolation valve 120 (e.g., a solenoid valve) to control the state of the isolation valve 120. When the heat pump system 100 starts operating in a heating mode from being idle or from a cooling mode, the control unit 116 may control the isolation valve 120 to open or keep open a flow path for refrigerant to flow from the refrigerant pipe 130 to the charge compensator 110 through the liquid line piping including pipe sections 126, 128. For example, during a heat mode operation, some of the system refrigerant flowing in the system refrigerant circulation piping may flow into the charge compensator 110 through the liquid line piping and the isolation valve 120 as illustrated by the dotted arrow 134. The control unit 116 may control the isolation valve 120 to allow the flow of refrigerant to the charge compensator 110 through the liquid line piping until the charge compensator 110 is full or at a certain fill level. For example, the control unit 116 may control the isolation valve 120 such that the isolation valve 120 is open to allow the refrigerant to flow to the charge compensator 110 through the isolation valve 120.

In some example embodiments, during heating mode operations, after some refrigerant is taken out of system circulation into the charge compensator 110 through the liquid line piping, the control unit 116 may control the isolation valve 120 (e.g., close the isolation valve 120) to prevent more refrigerant from flowing to the charge compensator 110 through the liquid line piping. For example, the control unit 116 may control the isolation valve 120 to close the flow path to the charge compensator 110 through the liquid line piping after a period of time following the start of a heating mode operation. The period of time that the control unit 116 waits before controlling the isolation valve 120 to stop the flow to the charge compensator 110 may depend on the system capacity, the size of the charge compensator 110, etc. as can be readily understood by those of ordinary skill in the art with the benefit of this disclosure. Once the isolation valve 120 is closed or the refrigerant flow to the charge compensator 110 is stopped during the heating mode operation, the isolation valve 120 may remain closed for the duration of the particular heating operation.

In some alternative embodiments, after some refrigerant is taken out of system circulation into the charge compensator 110 through the liquid line piping during a heating mode operation, the control unit 116 may control the isolation valve 120 to keep the flow path through the liquid line piping open until the operation mode of the heat pump system 100 is changed or needs to be changed to a defrost mode. To illustrate, the control unit 116 may determine that a defrost mode operation needs to be performed to remove frost from the outdoor coil 104, for example, based on an input from a frost thermostat at the outdoor coil 104. If the control unit 116 determines that a defrost mode operation needs to be performed, the control unit 116 may control the reversing valve 108 to change the operation mode of the heat pump system 100 to a defrost mode and control the isolation valve 120 to prevent the refrigerant stored in the charge compensator 110 during a heating mode operation from flowing to the refrigerant pipe 130 through the liquid line piping. For example, the control unit 116 may send a control signal to the isolation valve 120 to close the isolation valve 120 or otherwise close a flow path from the charge compensator 110 to the refrigerant pipe 130 through the liquid line piping.

In some example embodiments, if the heat pump system 100 returns to a heating mode operation following a defrost mode operation (i.e., without going into a cooling mode operation), the control unit 116 may control the isolation valve 120 to keep the refrigerant flow path between the refrigerant pipe 130 and the charge compensator 110 through the liquid line piping closed. Alternatively, the control unit 116 may control the isolation valve 120 to open the refrigerant flow path from the refrigerant pipe 130 to the charge compensator 110 through the liquid line piping if the heat pump system 100 returns to a heating mode operation following the defrost mode operation.

In some example embodiments, the control unit 116 may control the isolation valve 120 to allow the refrigerant that is stored in the charge compensator 110 during a heating mode operation to return to the refrigerant pipe 130 through the liquid line piping by flowing in the opposite direction to the dotted arrow 134. For example, the control unit 116 may control the reversing valve 108 to change the operation mode of the heat pump system 100 to a cooling mode and control the isolation valve 120 to allow the refrigerant stored in the charge compensator 110 to flow to the refrigerant pipe 130 through the liquid line piping. The control unit 116 may control the isolation valve 120 to keep the refrigerant flow path through the liquid line piping between the charge compensator 110 and the refrigerant pipe 130 open through the entire cooling mode operation.

In some example embodiments, the control unit 116 may control the reversing valve 108 to change the operation mode of the heat pump system 100 at substantially the same time (e.g., 10 seconds, 5 seconds, 100 milliseconds, etc. before or after) that the control unit 116 controls the isolation valve 120 to open or close the flow path of refrigerant through the liquid line piping. For example, the control unit 116 may include a microprocessor or a microcontroller, one or more memory devices, and other components and may send respective control signals to the reversing valve 108 and the isolation valve 120. To illustrate, a microcontroller of the control unit 116 may execute a software code stored in a memory device of the control unit 116 to perform some of the operation described herein with respect to the control unit 116.

In some alternative embodiments, the heat pump system 100 may include other components than shown in FIG. 1 without departing from the scope of this disclosure. For example, the heat pump system 100 may include a filter-drier between the expansion devices 112, 114. In particular, a filter-drier may be in-line with the system refrigerant circulation piping between the connection point of the pipe section 126 to the refrigerant pipe 130 and the expansion device 112. In some alternative embodiments, some of the components of the heat pump system 100 may be integrated into a single component without departing from the scope of this disclosure. For example, the isolation valve 120 may be integrated into the charge compensator 110.

Figure 2:
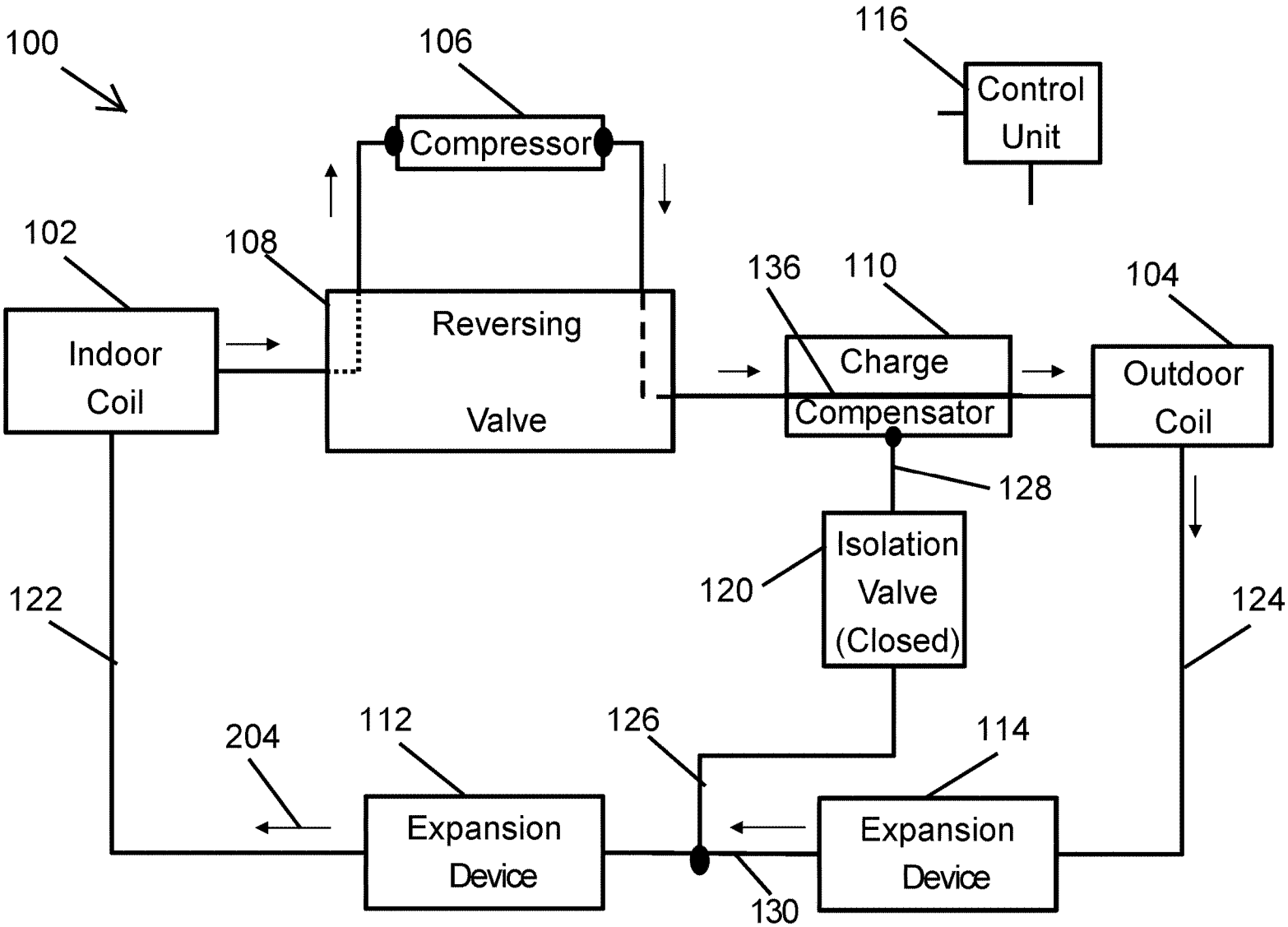
FIG. 2 illustrates the heat pump system of FIG. 1 configured for a defrost mode operation according to an example embodiment.

FIG. 2 illustrates the heat pump system 100 of FIG. 1 configured for a defrost mode operation according to an example embodiment. As shown in FIG. 2, the reversing valve 108 is controlled by control unit 116 to operate in a defrost mode such that the system refrigerant flows through the system refrigerant circulation piping in directions shown by the solid arrows such as the solid arrow 204. When the heat pump system 100 is configured to operate in a defrost mode as shown in FIG. 2, the system refrigerant flows from the indoor coil 102 to the suction port of the compressor 106 through the reversing valve 108 and from the discharge port of the compressor 106 to the outdoor coil 104 through the reversing valve 108 and the charge compensator 110. The configuration of the reversing valve 108 as shown in FIG. 2 provides a flow path for the system refrigerant to flow from the indoor coil 102 to the outdoor coil 104 through the reversing valve 108 and through the charge compensator 110

(i.e., through the flow path 136). When the heat pump system 100 is configured to operate in a defrost mode as shown in FIG. 2, the outdoor coil 104 operates as a condenser, which allows the outdoor coil 104 to dissipate heat to defrost the outdoor coil 104.

In some example embodiments, the heat pump system 100 may be configured to operate in the defrost mode in response to a frost build-up on the outdoor coil 104 during a heating mode operation of the heat pump system 100. As described above, the control unit 116 may determine that the heat pump system 100 needs to operate in a defrost mode operation to remove frost from the outdoor coil 104, for example, based on an input from a temperature sensor at the outdoor coil 104. Alternatively, the control unit 116 may determine the need to operate in a defrost mode using other means as can be readily understood by those of ordinary skill in the art with the benefit of this disclosure. In some alternative embodiments, the control unit 116 may be configured to periodically interrupt heating mode operations of the heat pump system 100 and to operate the heat pump system 100 in a defrost mode to remove frost that may accumulate on the outdoor coil 104.

As illustrated in FIG. 2, during defrost mode operations, the isolation valve 120 is closed or otherwise prevents the flow of refrigerant from the charge compensator 110 to the system refrigerant circulation piping that includes the refrigerant pipe 130. To illustrate, if the flow path of refrigerant from the charge compensator 110 to the system refrigerant circulation piping was closed during the immediately prior heating mode operation, the control unit 116 may maintain the flow path closed using the isolation valve 120 when the heat pump system 100 enters the defrost mode. If the flow path of refrigerant from the charge compensator 110 to the system refrigerant circulation piping was open during the immediately prior heating mode operation, the control unit 116 may close the flow path using the isolation valve 120 when the heat pump system 100 enters the defrost mode. By preventing the return of refrigerant from the charge compensator 110 into system circulation during defrost mode operations, a higher discharge temperature of the refrigerant leaving the compressor 106 may be achieved, resulting in faster defrosting of the outdoor coil 104.

In some example embodiments, after the defrost operation is performed, the control unit 116 may configure the reversing valve 108 to operate the heat pump system 100 back in a heating mode. For example, the control unit 116 may operate the heat pump system 100 in the defrost mode until the temperature of the outdoor coil reaches a particular temperature (e.g., above 55° F.) or may operate in the defrost mode for a time period (dependent on the particular system) that would allow adequate defrosting. Immediately before, at the same time, or after configuring the reversing valve 108 to operate in a heating mode from the defrost mode operation, the control unit 116 may control the isolation valve 120 such that the refrigerant flow path through the liquid line piping is open. Alternatively, the control unit 116 may control the isolation valve 120 to keep the refrigerant flow path through the liquid line piping closed during the heating mode operation that is subsequent to the defrost mode operation.

In some alternative embodiments, during defrost mode operations of the heat pump system 100, the control unit 116 may control the isolation valve 120 such that, instead of preventing the flow of the refrigerant stored in the charge compensator 110 to the system refrigerant circulation piping, some of the refrigerant flows to the system refrigerant circulation piping. For example, the control unit 116 may control the isolation valve 120 for a duration of time at the start of the defrost mode of operation. The duration of time may vary depending on the system capacity, the capacity of the charge compensator 110, etc.

Figure 3:
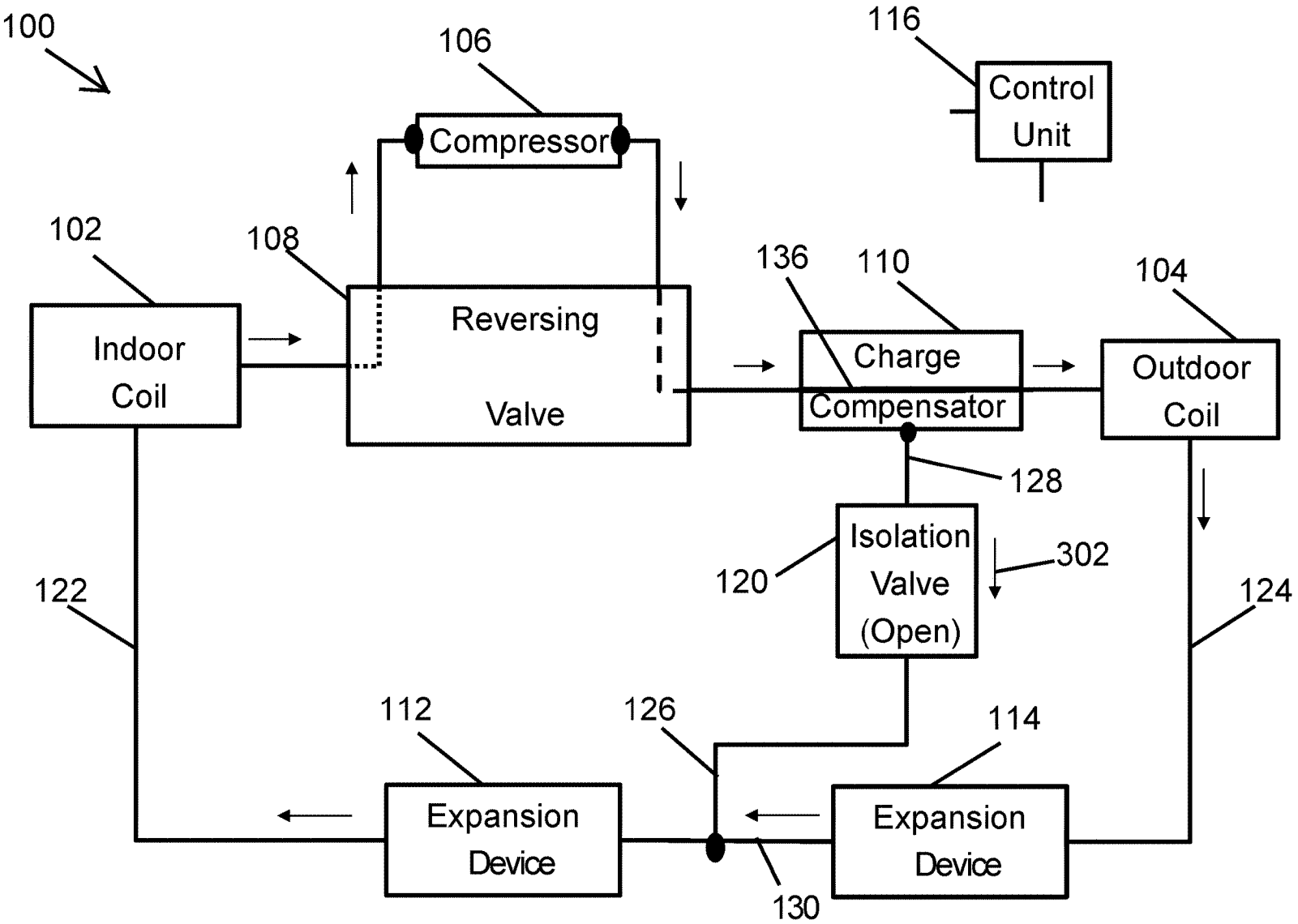
FIG. 3 illustrates the heat pump system of FIG. 1 configured for a cooling mode operation according to an example embodiment.

FIG. 3 illustrates the heat pump system 100 of FIG. 1 configured for a cooling mode operation according to an example embodiment. The cooling mode configuration of the reversing valve 108 as shown in FIG. 3 is the same as the defrost mode configuration of the reversing valve 108 shown in FIG. 2. To illustrate, when the heat pump system 100 is configured to operate in a cooling mode as shown in FIG. 3, the system refrigerant flows from the indoor coil 102 to the suction port of the compressor 106 through the reversing valve 108 and from the discharge port of the compressor 106 to the outdoor coil 104 through the reversing valve 108 and the charge compensator 110. As shown in FIG. 3, the reversing valve 108 provides a flow path for the system refrigerant to flow from the indoor coil 102 to the outdoor coil 104 through the reversing valve 108 and through the charge compensator 110 (i.e., through the flow path 136).

As illustrated in FIG. 3, during cooling mode operations, the isolation valve 120 is open or otherwise allows the flow of refrigerant from the charge compensator 110 to the system refrigerant circulation piping as shown by the arrow 302. If the isolation valve 120 was configured to allow refrigerant flow from the charge compensator 110 through the liquid line piping during an immediately prior heating mode operation, the control unit 116 may maintain the configuration of the isolation valve 120 when the heat pump system 100 enters the cooling mode. If the isolation valve 120 was configured to prevent refrigerant flow from the charge compensator 110 through the liquid line piping during the immediately prior heating mode operation, the control unit 116 may control the isolation valve 120 to allow refrigerant flow from the charge compensator 110 to the refrigerant pipe 130 through the liquid line piping when the heat pump system 100 enters the cooling mode.

Referring to FIGS. 1-3, by preventing the return of refrigerant from the charge compensator 110 into system circulation during defrost mode operations, a higher discharge temperature of the refrigerant leaving the compressor 106 may be achieved, resulting in faster defrosting of the outdoor coil 104. By allowing refrigerant to flow to the charge compensator 110 for storage during heating mode operations, by allowing the stored refrigerant to enter circulation during cooling mode operations, and by preventing the return of the refrigerant from the charge compensator 110 into circulation during defrost mode operations, the isolation valve 120 allows for more efficient defrosting operations without disrupting the regular cooling and heating mode operations of the heat pump system 100.

In some alternative embodiments, the isolation valve 120 may be fluidly coupled to the system refrigerant circulation piping at a different location than the refrigerant pipe 130 without departing from the scope of this disclosure.

Figure 4:
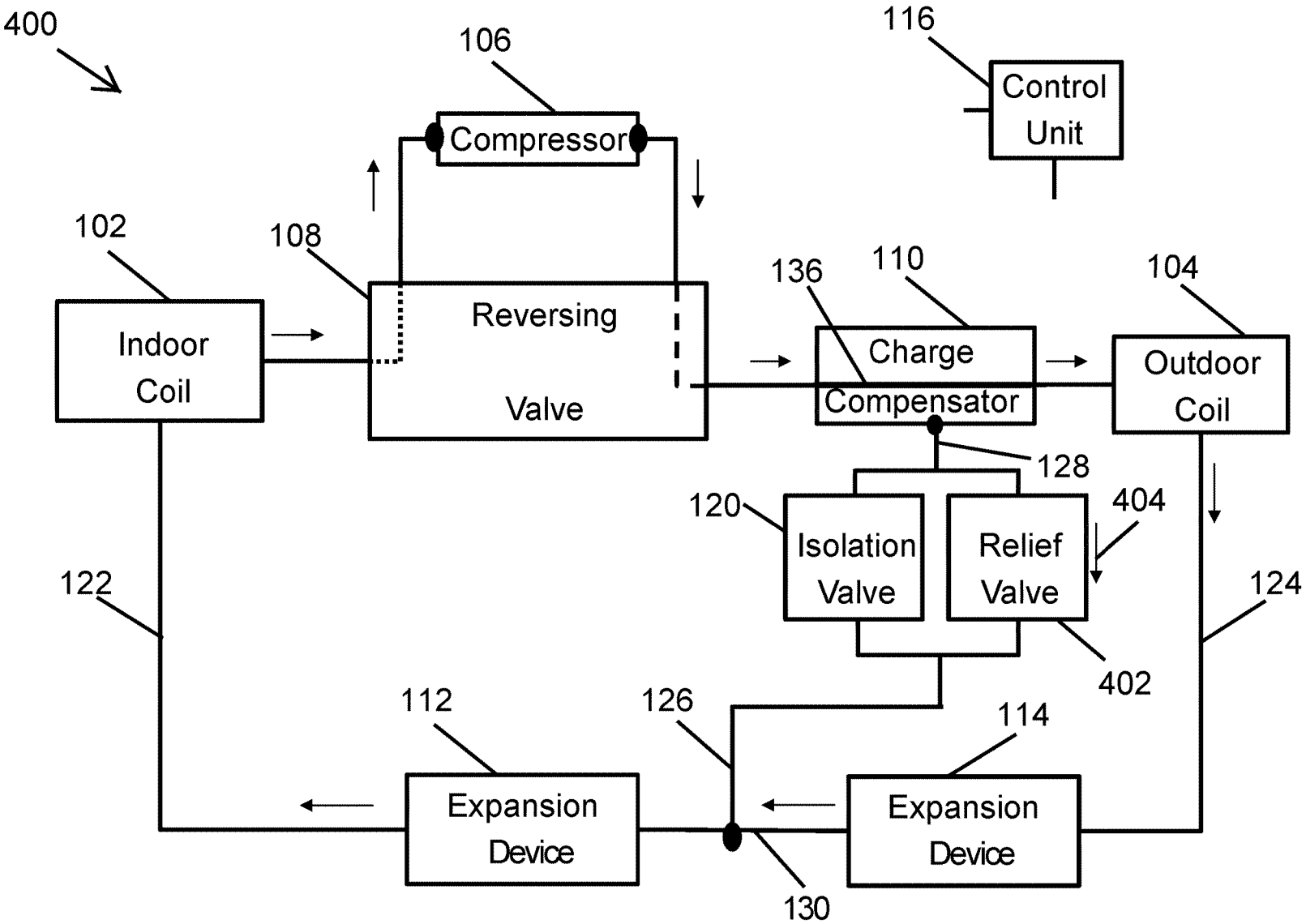
FIG. 4 illustrates a heat pump system including an isolation valve according to another example embodiment.

FIG. 4 illustrates a heat pump system 400 including the isolation valve 120 according to another example embodiment. In some example embodiments, the heat pump system 400 includes the same components and operates in substantially the same manner as the heat pump system 100. To illustrate, the heat pump system 400 includes the indoor coil 102, the outdoor coil 104, the compressor 106, the reversing valve 108, the charge compensator 110, the expansion devices 112, 114, and the isolation valve 120. In contrast to the heat pump system 100, the heat pump system 400 includes a relief valve 402.

In some example embodiments, the heat pump system 400 may operate in a heating mode, a defrost mode, and a cooling mode in the same manner as described with respect to the heat pump system 100. To configure the heat pump system 400 to operate in a defrost mode as shown in FIG. 4, the control unit 116 may configure the reversing valve 108 such that system (i.e., circulating) refrigerant flows from the indoor coil 102 to the suction port of the compressor 106 through the reversing valve 108 and from the discharge port of the compressor 106 to the outdoor coil 104 through the reversing valve 108 and the charge compensator 110. The configuration of the reversing valve 108 as shown in FIG. 4 provides a flow path for the system refrigerant to flow from the indoor coil 102 to the outdoor coil 104 through the reversing valve 108 and through the charge compensator 110 (i.e., through the flow path 136). When the heat pump system 400 is configured to operate in a defrost mode as shown in FIG. 4, the outdoor coil 104 operates as a condenser, which allows the outdoor coil 104 to dissipate heat to remove frost from the outdoor coil 104 that might have accumulated, for example, during a heating mode operation.

In some example embodiments, the isolation valve 120 operates in the same manner as described above with respect to the heat pump system 100. For example, during a defrost mode operation of the heat pump system 400, the isolation valve 120 is closed or otherwise prevents refrigerant stored in the charge compensator 110 from flowing from the charge compensator 110 to the system refrigerant circulation piping through the liquid line piping that includes the pipes 126, 128. During cooling mode operations, where the reversing valve 108 has the same configuration as in defrost mode operations, the isolation valve 120 is open or otherwise allows refrigerant stored in the charge compensator 110 to flow from the charge compensator 110 to the system refrigerant circulation piping through the liquid line piping.

During heating mode operations, the isolation valve 120 may be open or otherwise allow some of the system refrigerant to flow to the charge compensator 110 through the liquid line piping. For example, the isolation valve 120 may be open during all heating mode operations. Alternatively, the isolation valve 120 may be open during a heating mode operation and may then be closed when the heat pump system 400 switches to a defrost mode operation. Upon the heat pump system 400 returning to a subsequent heating mode operation from a defrost mode operation, the isolation valve 120 may remain closed for the duration of the subsequent heating mode operation. Alternatively, when the heat pump system 400 first enters a heating mode operation, the isolation valve 120 may be opened or otherwise allow some of the system refrigerant to flow to the charge compensator 110 through the liquid line piping. The isolation valve 120 may be closed by the control unit 116 when the charge compensator 110 fills up or is filled by refrigerant to a particular fill level.

In some example embodiments, the relief valve 402 may be placed in parallel with the isolation valve 120 to provide a bypass flow path to protect against excessive pressure build up in the charge compensator 110 when the isolation valve 120 is closed or otherwise prevents the flow of refrigerant from the charge compensator 110 to the refrigerant pipe 130. The relief valve 402 may be a spring loaded spring valve or another type of pressure-actuated valve that opens to relieve pressure in the charge compensator 110 when the pressure in the charge compensator 110 or across the relief valve 402 reaches or exceeds a threshold. The relief valve 402 may close when the pressure in the charge compensator 110 or across the relief valve 402 is below threshold.

For example, the relief valve 402 may be an in-line relief valve that open to provide a refrigerant flow path through the relief valve 402 in a direction shown by the arrow 404 when the pressure in the charge compensator 110 reaches or exceeds a threshold or when the pressure across the relief valve 402 reaches or exceeds a threshold. When opened, the refrigerant flow path through the relief valve 402 allows some of the refrigerant stored in the charge compensator 110 to flow to the refrigerant pipe 130, resulting in a decreased pressure inside the charge compensator 110. The flow path through the relief valve 402 closes when the pressure in the charge compensator 110 or the pressure across the relief valve 402 decreases, for example, to below a threshold level. The pressure threshold levels for opening the flow path through the relief valve 402 in the direction shown by the arrow 404 may depend on the system capacity, the capacity of the charge compensator 110, etc. as can be readily understood by those of ordinary skill in the art with the benefit of this disclosure.

By allowing refrigerant to flow to the charge compensator 110 for storage during heating mode operations, by allowing the stored refrigerant to enter circulation during cooling mode operations, and by preventing the return of the refrigerant from the charge compensator 110 into circulation during defrost mode operations, the isolation valve 120 allows for more efficient defrosting operations without disrupting the regular cooling and heating mode operations of the heat pump system 400. By allowing pressure reduction in the charge compensator 110 as needed, the relief valve 402 may provide improved system performance by reducing the risk of system malfunction.

In some alternative embodiments, the relief valve 402 may be coupled in a different piping configuration than shown without departing from the scope of this disclosure. For example, the isolation valve 120 and the relief valve 402 may be fluidly coupled to the refrigerant pipe 130 using separate pipes instead of the pipe section 126 without departing from the scope of this disclosure. In some alternative embodiments, the heat pump system 400 may include other components than shown in FIG. 4 without departing from the scope of this disclosure. For example, the heat pump system 400 may include a filter-drier between the expansion devices 112, 114. In some alternative embodiments, some of the components of the heat pump system 400 may be integrated into a single component without departing from the scope of this disclosure. For example, the isolation valve 120 may be integrated into the charge compensator 110.

Figure 5:
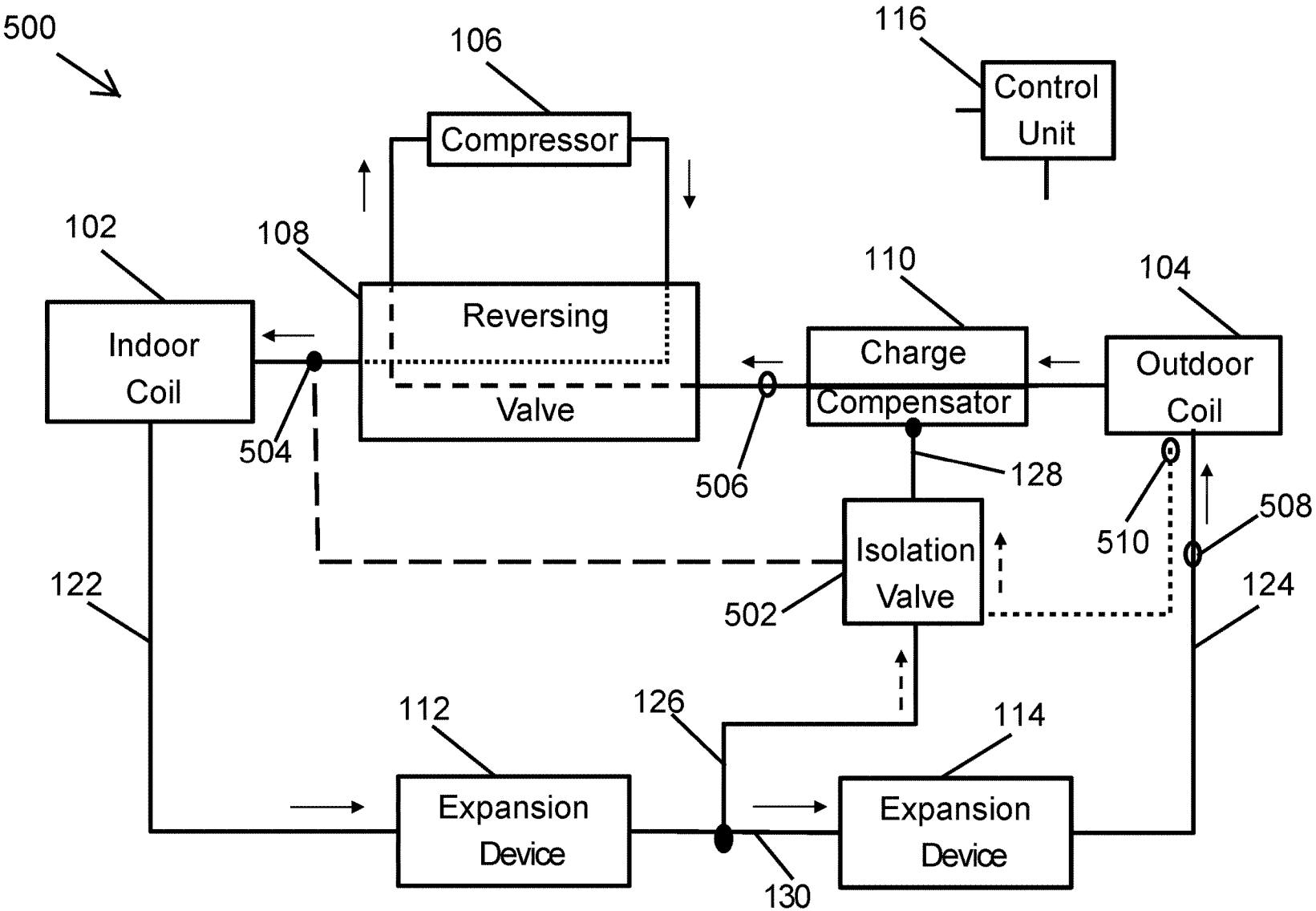
FIG. 5 illustrates a heat pump system including an isolation valve according to another example embodiment.
Figure 6:
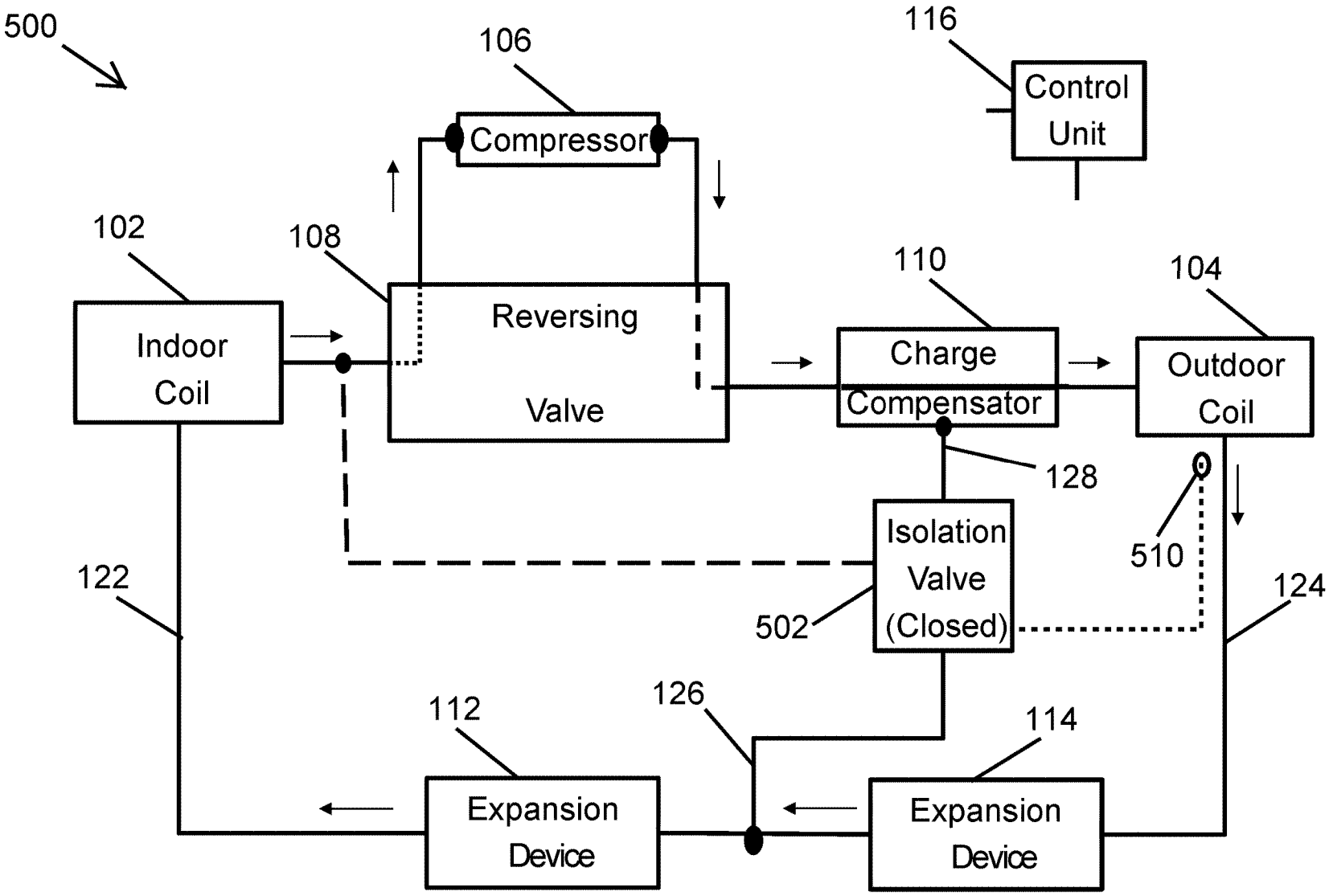
FIG. 6 illustrates the heat pump system of FIG. 5 configured for a defrost mode operation according to an example embodiment.
Figure 7:
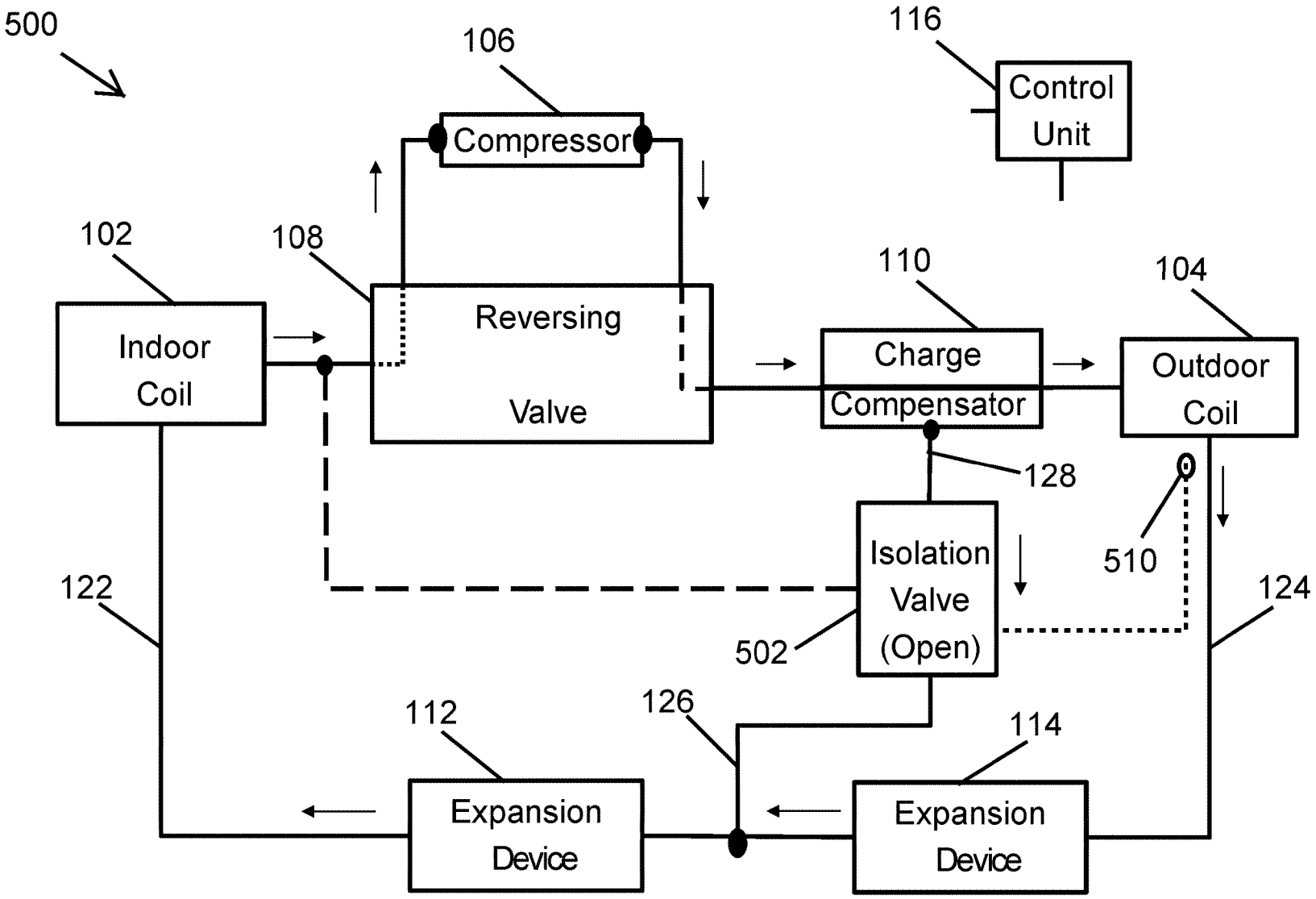
FIG. 7 illustrates the heat pump system of FIG. 5 configured for a cooling mode operation according to an example embodiment.

FIGS. 5-7 illustrate a heat pump system 500 including an isolation valve 502 according to another example embodiment. As shown in FIG. 5, the heat pump system 500 is configured for heating mode operations. As shown in FIG. 6, the heat pump system 500 is configured for defrost mode operations. As shown in FIG. 7, the heat pump system 500 is configured for cooling mode operations. The heat pump system 500 includes components described above with respect to the heat pump system 100. To illustrate, the heat pump system 500 includes the indoor coil 102, the outdoor coil 104, the compressor 106, the reversing valve 108, the charge compensator 110, the expansion devices 112, 114.

In some example embodiments, the control unit 116 controls the reversing valve 108 to configure the heat pump system 500 in a heating mode, a cooling mode, and a defrost mode in the same manner as described above with respect to the heat pump system 100. In contrast to the heat pump system 100, the heat pump system 500 includes the isolation valve 502 that is temperature actuated instead of being controlled by the control unit 116. To illustrate, the heat pump system 500 may include a temperature sensor 504 (e.g., a temperature sensing bulb) that is coupled to the isolation valve 502. For example, the temperature sensor 504 may be positioned to sense the temperature of the system refrigerant flowing between the indoor coil 102 and the reversing valve 108 as shown in FIG. 1. Alternatively, the temperature sensor 504 be positioned at a different location, such as the location 506 or 508, without departing from the scope of this disclosure.

In some example embodiments, the isolation valve 502 may operate as a typical temperature actuated valve that responds to an input corresponding to a temperature that is below or above a threshold temperature. To illustrate, the isolation valve 502 may be opened or closed in response to an input provided from the temperature sensor 504. For example, the temperature sensor 504 may be configured to provide a frost indicator input to the isolation valve 502 when the system refrigerant temperature, as sensed by the temperature sensor 504, reaches or decreases to below a frost threshold temperature (e.g., 35° F.) that is indicative of a frost accumulation on the outdoor coil 104. To illustrate, the temperature sensor 504 may be configured to provide the frost indicator input to the isolation valve 502 when the temperature of the system refrigerant, as sensed by the temperature sensor 504, corresponds to a frost condition that would trigger the control unit 116 to configure the reversing valve 108 for a defrost mode operation of the heat pump system 500. In response to the frost indicator input from the temperature sensor 504, the isolation valve 502 may close or otherwise prevent the flow of refrigerant from the charge compensator 110 to the refrigerant pipe 130 through the liquid line piping.

In some example embodiments, when the temperature sensor 504 no longer provides the frost indicator input to the isolation valve 502 or provides a different input corresponding to a temperature of the system refrigerant that is higher than the frost threshold temperature or another higher temperature, the isolation valve 502 may open or otherwise allow the flow of refrigerant from the charge compensator 110 to the refrigerant pipe 130 through the liquid line piping. For example, the temperature sensor 504 may be configured to stop providing the frost indicator input or to provide another input to the isolation valve 502 when the temperature of the system refrigerant, as sensed by the temperature sensor 504, corresponds to a condition indicative of the control unit 116 operating the heat pump system 500 in a mode (heating or cooling mode) other than the defrost mode.

In some alternative embodiments, instead of or in addition to the temperature sensor 504, the system 500 may include an air temperature sensor 510 (e.g., a temperature sensing bulb) that is located close to the outdoor coil 104. The air temperature sensor 510 may be located to sense air temperature at the outdoor coil 104 without being directedly attached to the outdoor coil 104. For example, the air temperature sensor 510 may be located upstream of the outdoor coil 104 such that the air temperature sensed by the temperature sensor 504 is not meaningfully affected by air flow over the outdoor coil 104. Alternatively, the air temperature sensor 510 may be located at a different relative position with respect to the outdoor coil 104 (e.g., downstream of the outdoor coil 104), where the air temperature sensed by the air temperature sensor 504 may be meaningfully affected by air flow over the outdoor coil 104. In some example embodiments, the temperature sensor 504 may even be located inside an outdoor unit that includes the outdoor coil 104 without being directly attached to the outdoor coil 104 itself. In some alternative embodiments, the temperature sensor 510 may be at a different location than shown in FIG. 5 or described above, without departing from the scope of this disclosure.

In some example embodiments, the isolation valve 502 may operate based on an input provided from the temperature sensor 510 in a similar manner as described with respect to the temperature sensor 504. For example, the isolation valve 502 may operate as a typical temperature actuated valve that responds to the input from the temperature sensor 510 corresponding to a temperature that is below or above a threshold air temperature. To illustrate, the isolation valve 502 may be opened or closed in response to the input provided from the temperature sensor 510. For example, the temperature sensor 510 may be configured to provide a valve control input to the isolation valve 502 that indicates whether the air temperature, as sensed by the air temperature sensor 510, is at, below, and/or above the threshold air temperature.

To illustrate, when the air temperature sensed by the air temperature sensor 510 is above the threshold air temperature, the valve control input from the air temperature sensor 510 may indicate that the isolation valve should be open. When the air temperature sensed by the air temperature sensor 510 is at or below the threshold air temperature, the valve control input from the air temperature sensor 510 may indicate that the isolation valve should be closed. The isolation valve 502 may open (or otherwise allow refrigerant flow between the charge compensator 110 and the refrigerant pipe 130 through the liquid line piping) or close (or otherwise prevent the flow of refrigerant from the charge compensator 110 to the refrigerant pipe 130 through the liquid line piping) depending on the valve control input from the temperature sensor 510. As a non-limiting example, the threshold air temperature may be within a temperature range of 35° F. to 50° F. (e.g., a temperature in 45° F.) when the air temperature sensor 510 is on the upstream side of the outdoor coil 104. The temperature range by be slightly different (e.g., lower values at both end limits) when the air temperature sensor 510 is on the downstream side of the outdoor coil 104 where the air temperature sensed by the air temperature sensor 510 may be affected by air flow passing over the outdoor coil 104. In general, the upper limit of the temperature range may be set such that, when the system 500 starts operating in the heat mode, some of the refrigerant circulating in the system 500 can enter the charge compensator 110 through the isolation valve 502 before the isolation valve 502 is closed for the duration of the heating mode operation. In some alternative embodiments, the threshold air temperature for opening the isolation valve 502 may be different from the threshold air temperature for closing the isolation valve 502.

By preventing the refrigerant stored in the charge compensator 110 from entering the system refrigerant circulation piping through the liquid line piping during defrost mode operations and by allowing refrigerant flow to and from the charge compensator 110 through the liquid line piping during other modes of operations, the isolation valve 502 allows for more efficient defrosting operations without disrupting regular cooling and heating mode operations of the heat pump system 500.

In some alternative embodiments, the air temperature sensor 510 may be used in conjunction with the temperature sensor 504 to control the opening and closing of the isolation valve 502. For example, particular temperature/condition related indications from both sensors 504, 510 may be required to open and/or close the isolation valve 502. Alternatively, a temperature/condition related indication from one of the two sensors 504, 510 may be used to open and/or close the isolation valve 502. In some alternative embodiments, the heat pump system 500 may include the relief valve 402 shown in FIG. 4 without departing from the scope of this disclosure. For example, the relief valve 402 may be integrated in the heat pump system 500 in the same or similar configuration as in the heat pump system 400. In some alternative embodiments, the heat pump system 500 may include other components than shown in FIG. 5 without departing from the scope of this disclosure. For example, the heat pump system 500 may include a filter-drier between the expansion devices 112, 114. In some alternative embodiments, some of the components of the heat pump system 500 may be integrated into a single component without departing from the scope of this disclosure. For example, the isolation valve 120 may be integrated into the charge compensator 110.

Figure 8:
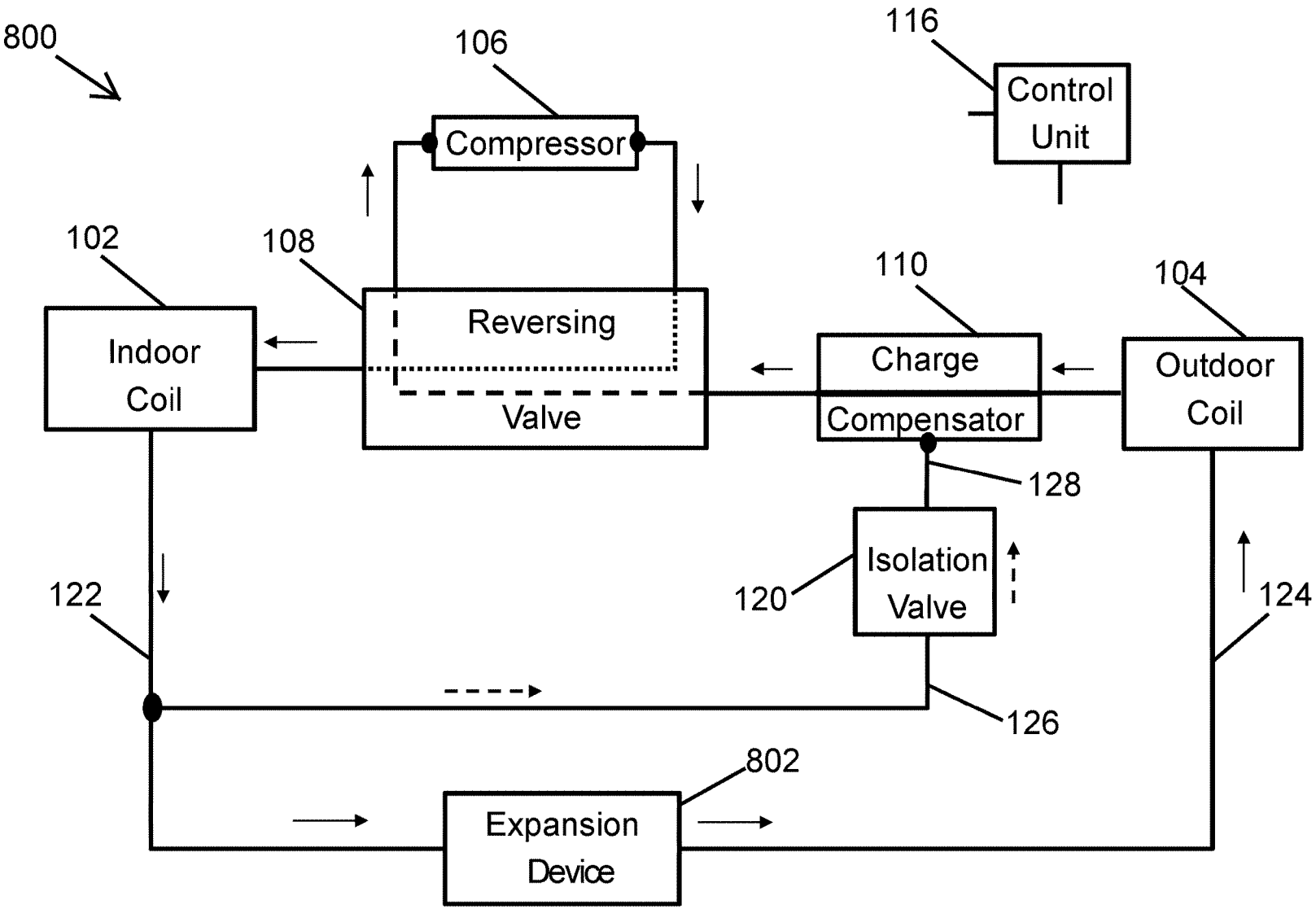
FIG. 8 illustrates a heat pump system including an isolation valve according to another example embodiment.
Figure 9:
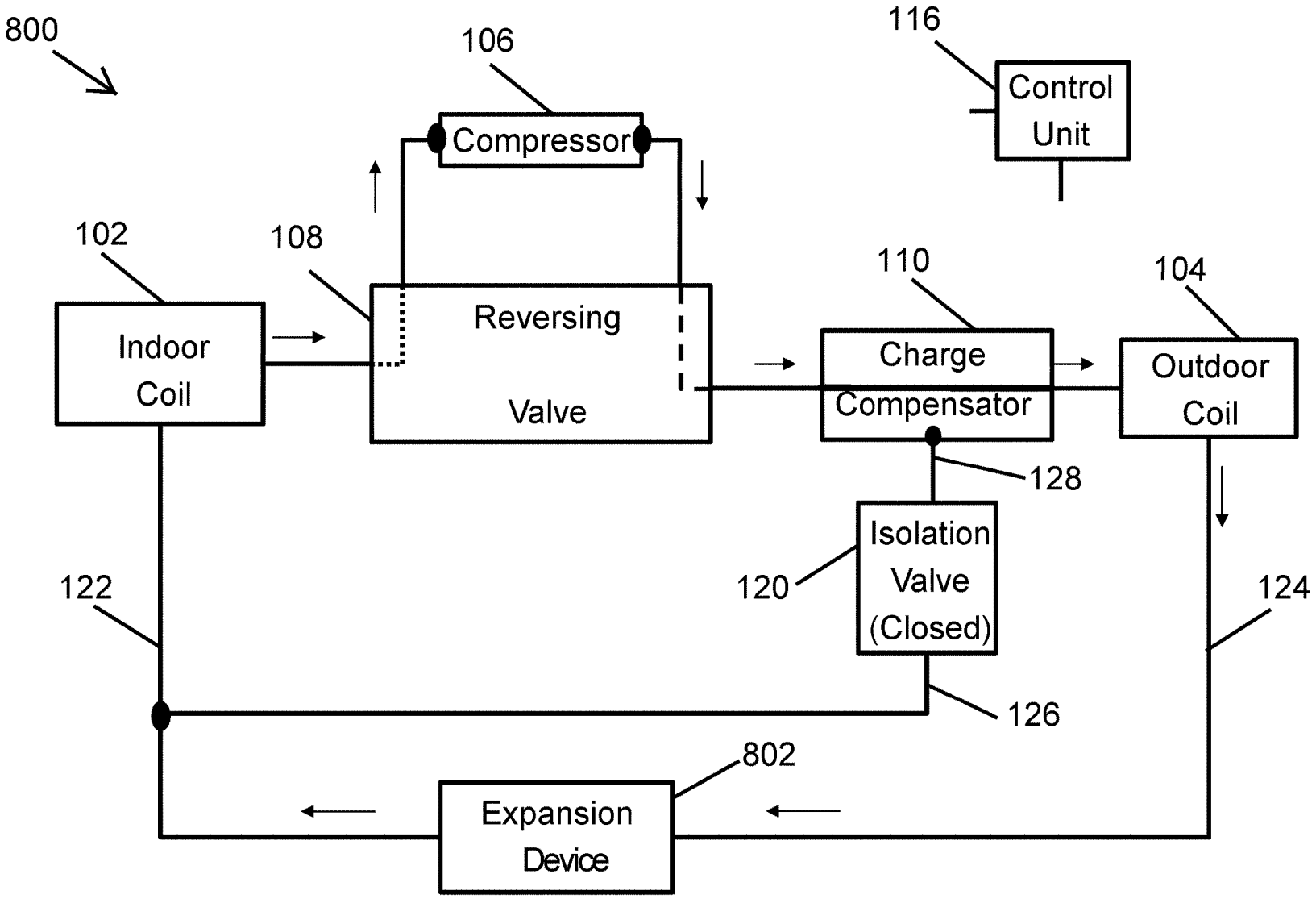
FIG. 9 illustrates the heat pump system of FIG. 8 configured for a defrost mode operation according to an example embodiment.
Figure 10:
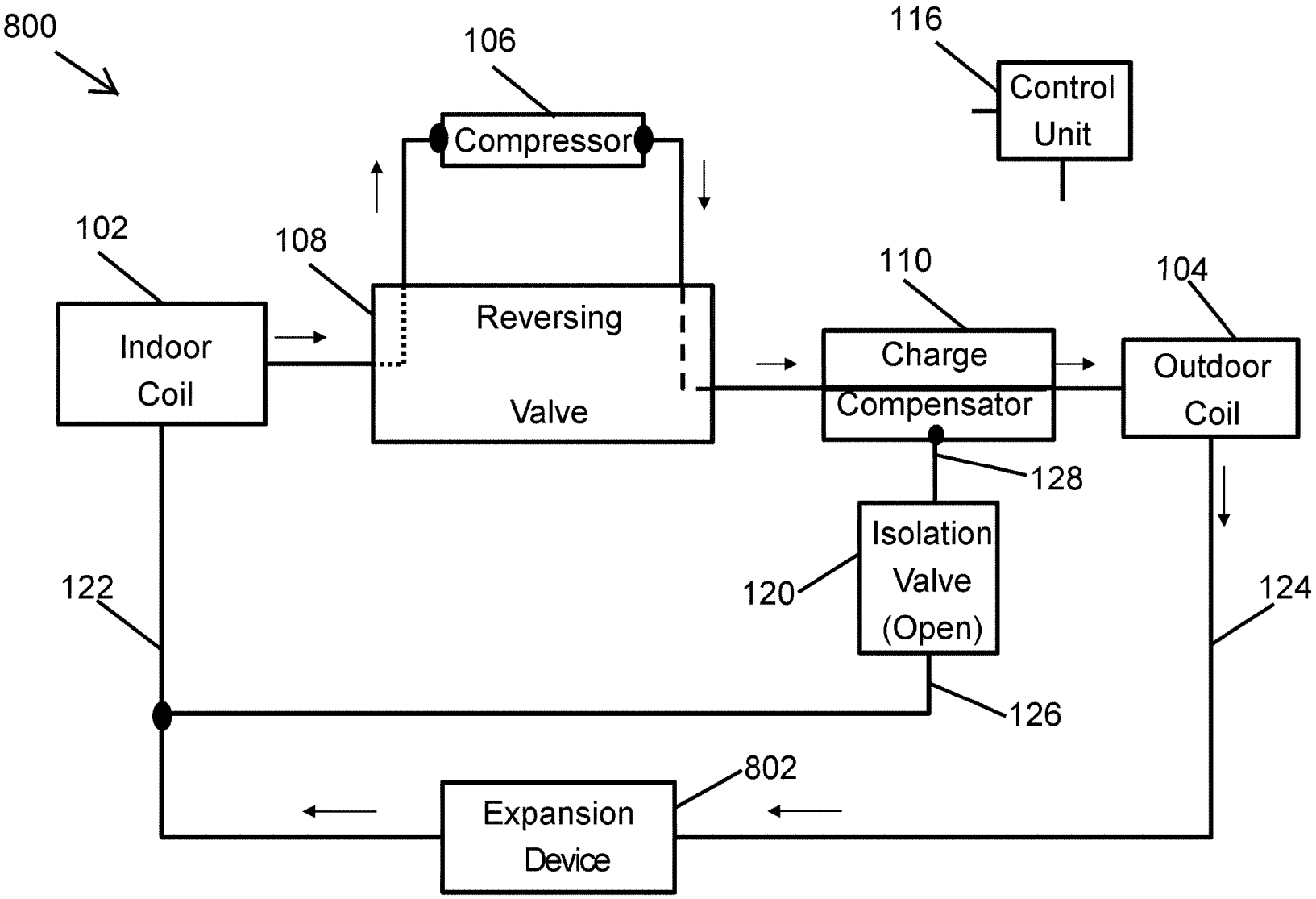
FIG. 10 illustrates the heat pump system of FIG. 8 configured for a cooling mode operation according to an example embodiment.

FIGS. 8-10 illustrate a heat pump system 800 including the isolation valve 120 according to another example embodiment. As shown in FIG. 8, the heat pump system 800 is configured for heating mode operations. As shown in FIG. 9, the heat pump system 800 is configured for defrost mode operations. As shown in FIG. 10, the heat pump system 800 is configured for cooling mode operations.

In some example embodiments, the heat pump system 800 includes components described above with respect to the heat pump system 100. To illustrate, the heat pump system 800 includes the indoor coil 102, the outdoor coil 104, the compressor 106, the reversing valve 108, the charge compensator 110, and the isolation valve 120. the expansion devices 112, 114. In contrast to the heat pump system 100, the heat pump system 800 includes a bidirectional expansion device 802 (e.g., a thermal expansion device or another type of expansion device) instead of the expansion devices 112, 114. To illustrate, the pipe section 126 of the liquid line piping of the heat pump system 800 is fluidly coupled to the system refrigerant circulation piping at the refrigerant pipe 122. For example, the expansion device 802 may be electronically or thermally activated.

In some example embodiments, the heat pump system 800 operates in heating modes, cooling modes, and defrost modes in the same manner as described above with respect to the heat pump system 100. To illustrate, the control unit 116 may control the reversing valve 108 to control the mode of operation of the heat pump system 800. The control unit 116 may also control the isolation valve 120 to control whether refrigerant flows to and from the charge compensator 110 during different operation modes of the heat pump system 800 in the same manner as described with respect to the heat pump system 100.

In some alternative embodiments, the heat pump system 800 may include the relief valve 402 shown in FIG. 4. For example, the relief valve 402 may be coupled in parallel with the isolation valve 120 to protect against excessive pressure build up in the charge compensator 110 when the isolation valve 120 is closed or otherwise prevents the flow of refrigerant from the charge compensator 110 to the refrigerant pipe 122.

In some alternative embodiments, the heat pump system 800 may include the isolation valve 502 of the heat pump system 500 instead of the isolation valve 120 shown in FIG. 8. For example, the heat pump system 800 may include the temperature sensor 504 that is coupled to the isolation valve 502 in the same manner as shown in FIG. 5, and the isolation valve 502 may operate based on input(s) from the temperature sensor 504 as described above instead of operating under the control of the control unit 116. In some alternative embodiments, the heat pump system 800 may include the relief valve 402 as well as the isolation valve 502, where the relief valve 402 is coupled in a similar configuration as described above to protect against excessive pressure build up in the charge compensator 110.

By allowing refrigerant to flow to the charge compensator 110 for storage during heating mode operations, by allowing the stored refrigerant to enter circulation during cooling mode operations, and by preventing the return of the refrigerant from the charge compensator 110 into circulation during defrost mode operations, the isolation valve 120 (alternatively the isolation valve 502) allows for more efficient defrosting operations without disrupting the regular cooling and heating mode operations of the heat pump system 800. When included, the relief valve 402 may provide improved system performance by reducing the risk of system malfunction.

In some alternative embodiments, the heat pump system 800 may include other components than shown in FIG. 8 without departing from the scope of this disclosure. For example, the heat pump system 800 may include a filter-drier between the expansion device 802 and the outdoor coil 104. In some alternative embodiments, some of the components of the heat pump system 800 may be integrated into a single component without departing from the scope of this disclosure. For example, the isolation valve 120 may be integrated into the charge compensator 110.

Figure 11:
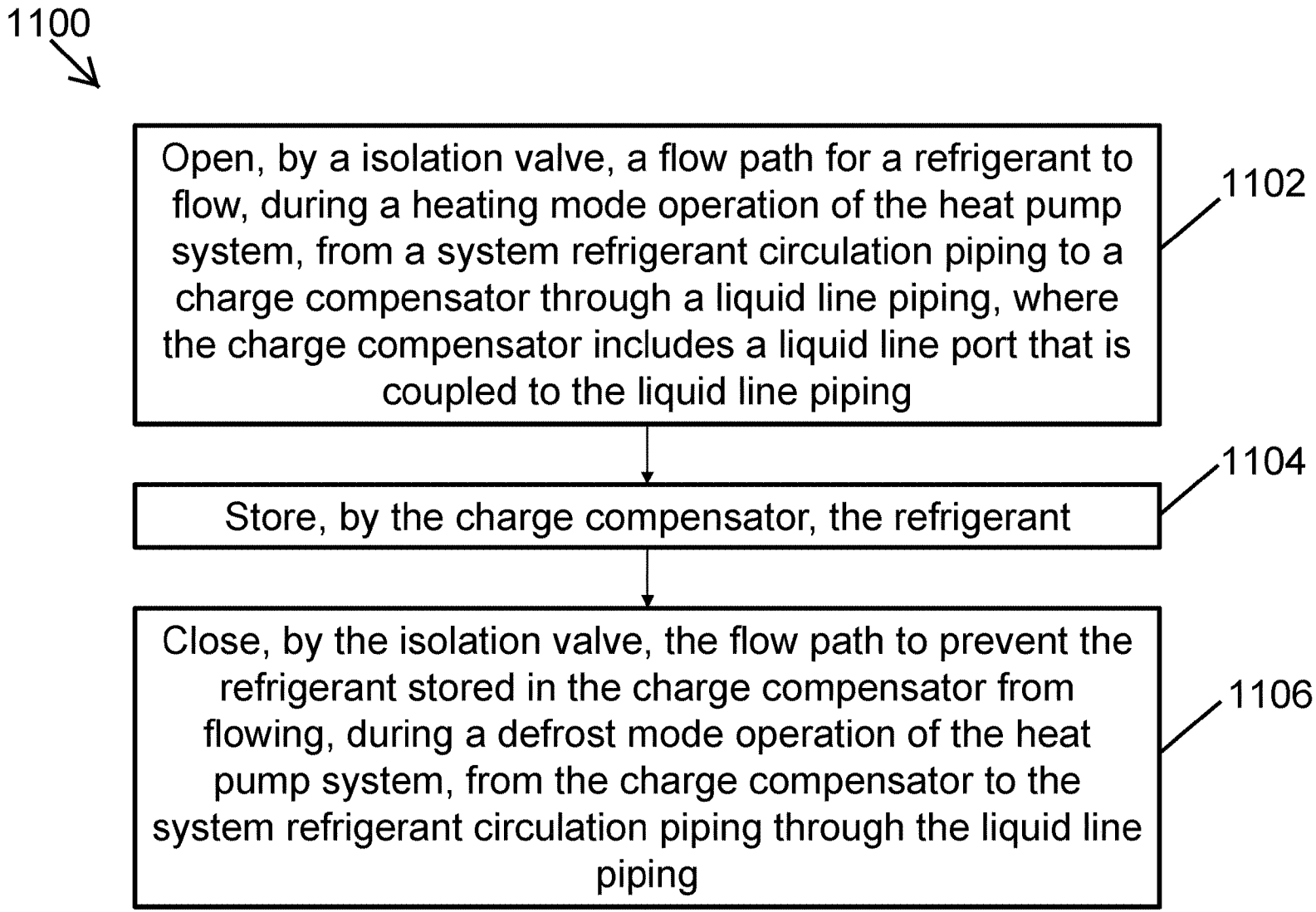
FIG. 11 illustrates a method of operating a heat pump system that includes an isolation valve according to an example embodiment.

FIG. 11 illustrates a method 1100 of operating the heat pump system 100, 400, 500, 800 that includes an isolation valve according to an example embodiment. Referring to FIGS. 1-11, in some example embodiments, the method 1100 includes, at step 1102, opening, by the isolation valve 120, 502, a flow path for a refrigerant to flow, during a heating mode operation of the heat pump system 100, 400, 500, 800, from the system refrigerant circulation piping to the charge compensator 110 through the liquid line piping. For example, the system refrigerant circulation piping may include refrigerant pipes 122, 130, etc. The liquid line piping may include the pipe sections 126 and 128. The charge compensator 110 includes the liquid line port 118 that is coupled to the pipe sections 128 of the liquid line piping.

In some example embodiments, at step 1104, the method 1100 may include storing, by the charge compensator 110, the refrigerant that flows to the charge compensator 110 from the system refrigerant circulation piping to the charge compensator 110 through the liquid line piping. For example, the charge compensator 110 may store the refrigerant until the charge compensator 110 is full or until the charge compensator 110 is filled to a particular level.

In some example embodiments, at step 1106, the method 1100 may include closing, by the isolation valve 120, 502, the flow path to prevent the refrigerant stored in the charge compensator 110 from flowing, during a defrost mode operation of the heat pump system 100, 400, 500, 800, from the charge compensator 110 to the system refrigerant circulation piping through the liquid line piping. For example, the flow path may be through the isolation valve 120, 502 or may be controlled by the isolation valve 120, 502.

In some example embodiments, the method 1100 may include other steps including opening or keeping open the flow path for the refrigerant stored in the charge compensator 110 to flow, during a cooling mode operation of the heat pump system, from the charge compensator 110 to the system refrigerant circulation piping through the liquid line piping. The method 1100 may also include providing, by the relief valve 402, a bypass flow path for at least a portion of the refrigerant stored in the charge compensator 110 to flow from the charge compensator 110 to the system refrigerant circulation piping of the heat pump system if a pressure in the charge compensator 110 exceeds a threshold.

In some alternative embodiments, the method 1100 may include more or fewer steps than described above without departing from the scope of this disclosure. In some example embodiments, some of the steps of the method 1100 may be performed in a different order than described above.

Figure 12:
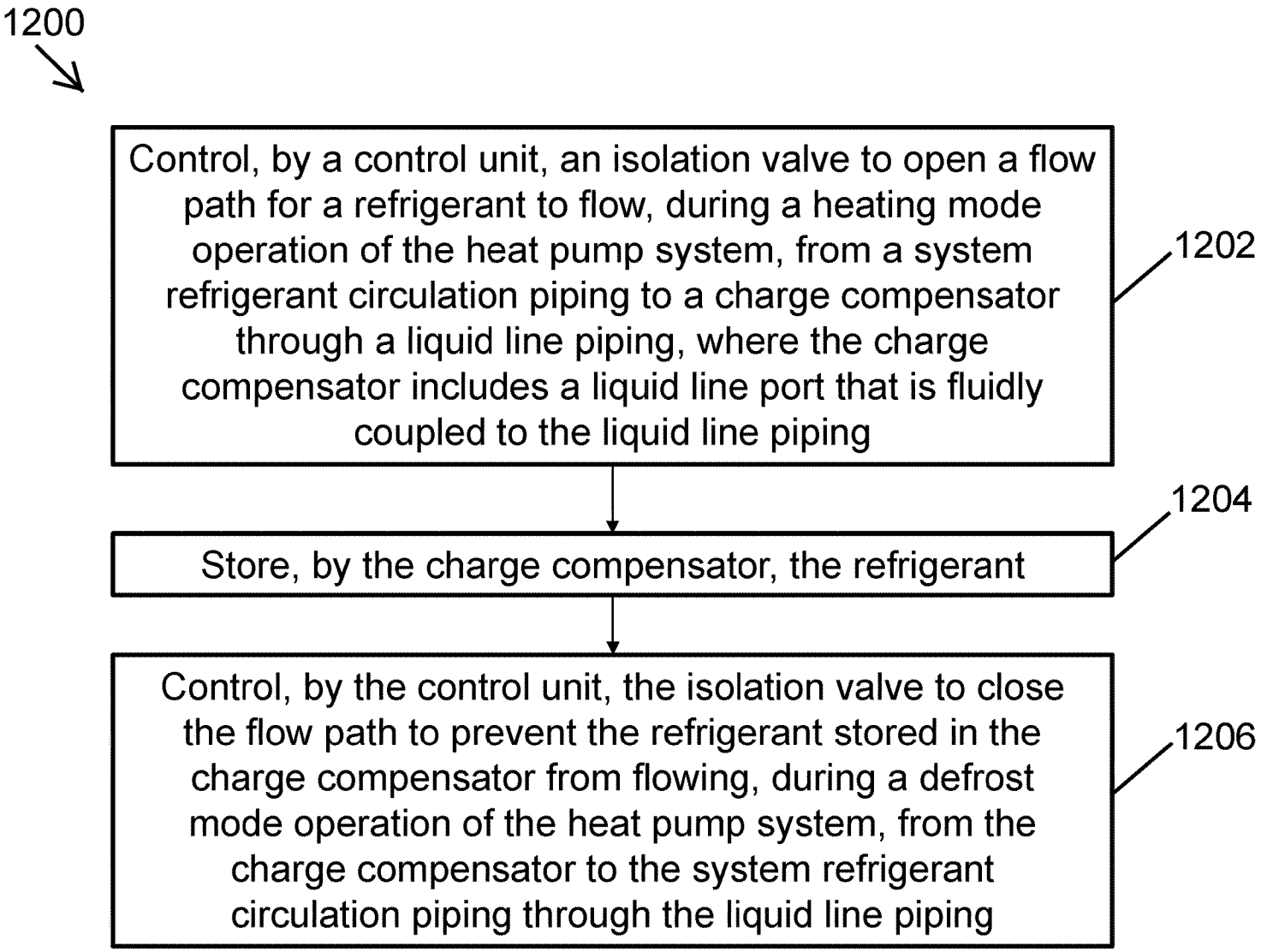
FIG. 12 illustrates a method of operating a heat pump system that includes an isolation valve according to another example embodiment.

FIG. 12 illustrates a method 1200 of operating a heat pump system 100, 400, 500, 800 that includes an isolation valve according to another example embodiment. Referring to FIGS. 1-10 and 12, in some example embodiments, the method 1200 includes, at step 2102, controlling, by the control unit 116, the isolation valve 120 to open a flow path for a refrigerant to flow, during a heating mode operation of the heat pump system 100, 400, 500, 800, from the system refrigerant circulation piping to the charge compensator 110 through the liquid line piping. For example, the system refrigerant circulation piping may include refrigerant pipes 122, 130, etc. The liquid line piping may include the pipe sections 126 and 128. The charge compensator 110 includes the liquid line port 118 that is coupled to the pipe sections 128 of the liquid line piping.

In some example embodiments, at step 1204, the method 1200 may include storing, by the charge compensator 110, the refrigerant that flows to the charge compensator 110 from the system refrigerant circulation piping to the charge compensator 110 through the liquid line piping. For example, the charge compensator 110 may store the refrigerant until the charge compensator 110 is full or until the charge compensator 110 is filled to a particular level.

In some example embodiments, at step 1206, the method 1200 may include controlling, by the control unit 116, the isolation valve 120 to close the flow path to prevent the refrigerant stored in the charge compensator 110 from flowing, during a defrost mode operation of the heat pump system 100, 400, 500, 800, from the charge compensator 110 to the system refrigerant circulation piping through the liquid line piping. For example, the flow path may be through the isolation valve 120, 502 or may be controlled by the isolation valve 120, 502.

In some example embodiments, the method 1200 may include other steps including opening or keeping open the flow path for the refrigerant stored in the charge compensator 110 to flow, during a cooling mode operation of the heat pump system, from the charge compensator 110 to the system refrigerant circulation piping through the liquid line piping. The method 1200 may also include providing, by the relief valve 402, a bypass flow path for at least a portion of the refrigerant stored in the charge compensator 110 to flow from the charge compensator 110 to the system refrigerant circulation piping of the heat pump system if a pressure in the charge compensator 110 exceeds a threshold.

In some alternative embodiments, the method 1200 may include more or fewer steps than described above without departing from the scope of this disclosure. In some example embodiments, some of the steps of the method 1200 may be performed in a different order than described above.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A heat pump system, comprising:

a charge compensator having a liquid line port for an inflow of a refrigerant into the charge compensator and for an outflow of the refrigerant from the charge compensator;

an isolation valve configured to control flows of the refrigerant to and from the charge compensator through a liquid line piping of the heat pump system based on whether the heat pump system is operating in a cooling mode, a defrost mode, or a heating mode, wherein the liquid line port is fluidly coupled to the liquid line piping of the heat pump system; and wherein, during the defrost mode, the isolation valve prevents the refrigerant from flowing from the charge compensator to a system refrigerant circulation piping of the heat pump system through the liquid line piping.

2. The heat pump system of claim 1, further comprising a relief valve fluidly coupled to and between the liquid line port and the system refrigerant circulation piping of the heat pump system to provide a bypass flow path for the refrigerant to flow from the charge compensator to the system refrigerant circulation piping if a pressure across the relief valve exceeds a safety threshold.

3. The heat pump system of claim 1, wherein, during the cooling mode, the isolation valve provides a flow path for the refrigerant to flow from the charge compensator to the system refrigerant circulation piping through the liquid line piping.

4. The heat pump system of claim 1, wherein, during the heating mode, the isolation valve provides a flow path for the refrigerant to flow from the system refrigerant circulation piping to the charge compensator through the liquid line piping.

5. The heat pump system of claim 1, further comprising:

an indoor coil; and an outdoor coil, wherein the charge compensator provides a refrigerant passageway for a system refrigerant to flow through the charge compensator between the indoor coil and the outdoor coil.

6. The heat pump system of claim 1, further comprising a control unit that controls the isolation valve based on whether the heat pump system is operating in the cooling mode, the defrost mode, or the heating mode, wherein the control unit is configured to control whether the heat pump system operates in the cooling mode, the defrost mode, or the heating mode.

7. The heat pump system of claim 6, further comprising a compressor and a reversing valve, wherein the control unit is configured to control the operations of the reversing valve to control whether the heat pump system operates in the cooling mode, the defrost mode, or the heating mode.

8. The heat pump system of claim 1, further comprising a temperature sensor, wherein the isolation valve is a temperature actuated valve, wherein the isolation valve controls the flows of the refrigerant to and from the charge compensator based on temperature information from the temperature sensor, and wherein the temperature information is indicative of whether the heat pump system is operating in the cooling mode, the defrost mode, or the heating mode.

9. A method of operating a heat pump system that includes an isolation valve, the method comprising:

controlling, by a control unit, the isolation valve to provide an inflow path for a refrigerant to flow to a charge compensator during a heating mode operation of the heat pump system, wherein the charge compensator includes a liquid line port for an inflow of the refrigerant into the charge compensator and for an outflow of the refrigerant from the charge compensator; and controlling, by the control unit, the isolation valve to prevent the refrigerant from flowing from the charge compensator to a system refrigerant circulation piping of the heat pump system through a liquid line piping of the heat pump system during a defrost mode operation of the heat pump system.

10. The method of claim 9, further comprising controlling, by the control unit, the isolation valve to provide an outflow path for the refrigerant to flow through the liquid line piping from the charge compensator to the system refrigerant circulation piping during a cooling mode operation of the heat pump system.

11. The method of claim 9, further comprising controlling, by the control unit, a reversing valve to control whether the heat pump system operates in a cooling mode operation, the defrost mode operation, or the heating mode operation.

12. The method of claim 11, further comprising providing, by the charge compensator, a refrigerant passageway for a system refrigerant to flow through the charge compensator between an indoor coil of the heat pump system and an outdoor coil of the heat pump system through the reversing valve.

13. The method of claim 9, wherein the isolation valve includes a solenoid valve.

14. The method of claim 9, further comprising providing, by a relief valve, a bypass flow path from the charge compensator to the system refrigerant circulation piping of the heat pump system in response to a pressure across the relief valve exceeding a safety threshold.

15. A method of operating a heat pump system that includes an isolation valve, the method comprising:

opening, by the isolation valve, a flow path for a refrigerant to flow, during a heating mode operation of the heat pump system, from a system refrigerant circulation piping to a charge compensator through a liquid line piping, wherein the charge compensator includes a liquid line port that is coupled to the liquid line piping;

storing, by the charge compensator, the refrigerant; and closing, by the isolation valve, the flow path to prevent the refrigerant stored in the charge compensator from flowing, during a defrost mode operation of the heat pump system, from the charge compensator to the system refrigerant circulation piping through the liquid line piping.

16. The method of claim 15, wherein the isolation valve is configured to open or keep open the flow path for the refrigerant stored in the charge compensator to flow, during a cooling mode operation of the heat pump system, from the charge compensator to the system refrigerant circulation piping through the liquid line piping.

17. The method of claim 15, wherein the isolation valve is a temperature actuated valve that controls refrigerant flows to and from the charge compensator based on one or more inputs from a temperature sensor.

18. The method of claim 15, further comprising providing, by a relief valve, a bypass flow path for at least a portion of the refrigerant stored in the charge compensator to flow from the charge compensator to the system refrigerant circulation piping of the heat pump system if a pressure in the charge compensator exceeds a threshold.

* * * * *